US006406099B2

(12) United States Patent
Boucherie

(10) Patent No.: US 6,406,099 B2
(45) Date of Patent: Jun. 18, 2002

(54) METHOD TO ATTACH BRUSH BRISTLE TUFTS ONTO CARRIERS MADE OF THERMOPLASTIC MATERIAL

(75) Inventor: Bart Gerard Boucherie, Izegem (BE)

(73) Assignee: G.B. Boucherie N.V., Izegem (BE)

( * ) Notice: Subject to any disclaimer, the term of this patent is extended or adjusted under 35 U.S.C. 154(b) by 0 days.

(21) Appl. No.: 09/742,309

(22) Filed: Dec. 22, 2000

(30) Foreign Application Priority Data

Dec. 22, 1999 (EP) ..... 99125901.01

(51) Int. Cl.[7] ..... A46D 3/00
(52) U.S. Cl. ..... 300/21
(58) Field of Search ..... 300/21

(56) References Cited

U.S. PATENT DOCUMENTS

| | | | | |
|---|---|---|---|---|
| 4,637,660 A | * | 1/1987 | Weihrauch | 300/21 |
| 5,474,366 A | * | 12/1995 | Strutt et al. | 300/21 |
| 5,622,411 A | | 4/1997 | Weihrauch | |

FOREIGN PATENT DOCUMENTS

| | | | | |
|---|---|---|---|---|
| DE | 4005276 | * | 8/1991 | 300/21 |
| DE | 19604533 A1 | | 8/1997 | |
| DE | 19738256 A1 | | 3/1999 | |
| DE | 19818553 C1 | | 8/1999 | |

* cited by examiner

*Primary Examiner*—Randall E. Chin
(74) *Attorney, Agent, or Firm*—Nixon Peabody LLP; Stuart J. Friedman

(57) ABSTRACT

In order to attach brush bristle tufts onto carriers made of thermoplastic material, which are formed with multiple holes according to a desired tuft pattern, the bristle tufts are first inserted into the holes in such a way that the bristle tips that are to be used protrude from one side while the bristle ends protrude only slightly from the holes on the opposite side. A heated punch has a multiplicity of conical or pyramidal projections. The projections of this punch penetrate between the holes into the mass of the carrier so that this mass softens and is pushed laterally into the interstices of the bristle tufts. In this manner, a tight interlock is created between the material of the bristles and that of the carrier.

9 Claims, 3 Drawing Sheets

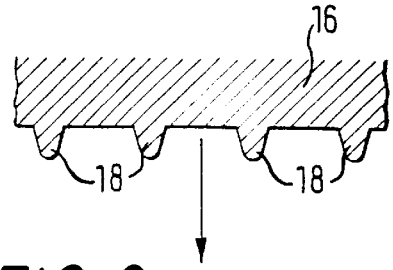
FIG. 2
FIG. 1
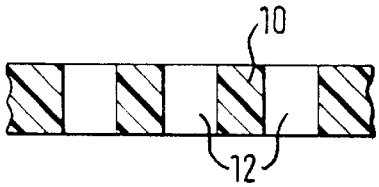
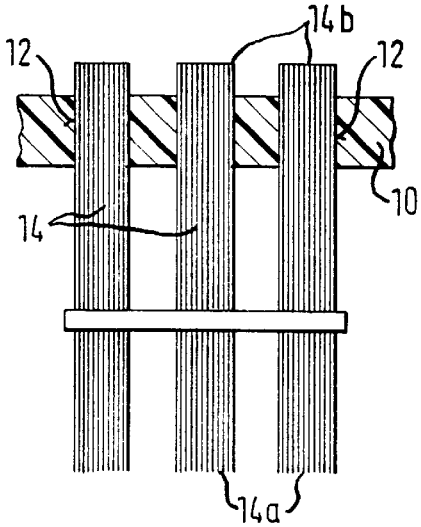
FIG. 3
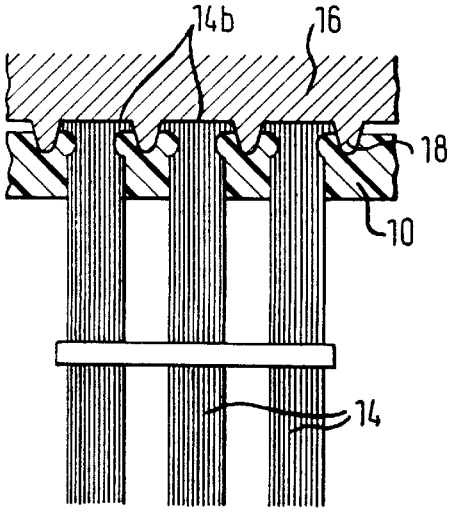
FIG. 4
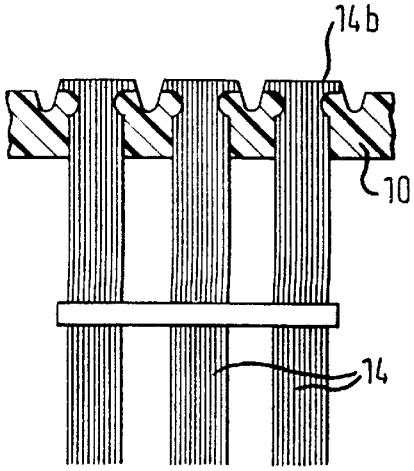

METHOD TO ATTACH BRUSH BRISTLE TUFTS ONTO CARRIERS MADE OF THERMOPLASTIC MATERIAL

TECHNICAL FIELD

The invention relates to a method to attach brush bristle tufts onto carriers made of thermoplastic material, which are incorporated into brush bodies.

BACKGROUND OF THE INVENTION

In order to produce brushes, brush bodies can be provided with a perforation pattern, corresponding to the desired tuft pattern. The bristle tufts are then inserted into the holes of the brush body and anchored in the holes. The anchoring of the bristle tufts in the brush body by means of anchor plates or loops, however, calls for very high-performance and thus complex machines.

According to an alternative brush manufacturing process, the bristle tufts are attached to a carrier that is then incorporated into a brush body, for example, during the injection molding process. The generally plate-shaped carrier is provided with holes corresponding to the desired perforation pattern. The bristle tufts are inserted into the holes, whereby the tips of the bristle tufts that are to be used protrude from one surface of the carrier while the axial ends of the bristle tufts that are to be anchored in the brush protrude slightly from the opposite side. These ends of the bristle tufts that are to be anchored in the brush body are then heated, fused together and shaped into a knob.

In order to ensure adequate axial anchoring of the bristle tufts in the carriers, DE 197 38 256 C2 has proposed providing the plate-like carriers with mushroom-shaped projections which are enclosed from below by the melted material of the bristles, so that the mushroom-shaped projections and the plastically deformed mass of the bristle tufts become interlocked. This process, however, calls for a great deal of work in order to provide the plate-shaped carrier with a multiplicity of mushroom-shaped projections.

BRIEF SUMMARY OF THE INVENTION

The invention provides a method of attaching brush bristle tufts to carriers made of thermoplastic material by means of which extremely simple method steps ensure a firm anchoring of the bristle ends in the carriers. According to the invention, a heated punch with projections penetrates between the holes into the mass of the carrier, softening it and pushing it laterally into the interstices of the bristle tufts. In this process, first of all, the material of the carrier is softened and deformed so that it tightly encircles the ends of the bristle tufts and, by penetrating into the interstices between the bristles, creates a tight interlocking fit. In the preferred embodiment of the method, the surface of the punch that is between the projections is then pressed against the axial ends of the bristle tufts, whereby the displaced mass of the bristles extends over the deformed mass of the carrier. Thus, a tight interlock is created between the carriers and the bristle tufts. Here, the projections encircle the axial ends of the bristle tufts and give the melted plastic compound a precisely defined shape. During this method, the bristle tufts are preferably held or supported axially so that they are not shifted axially in the holes of the carrier.

The invention also provides a device for executing the process which is characterized by a heatable punch with a working surface that has multiple projections arranged relative to the tuft insertion holes in the carrier.

BRIEF DESCRIPTION OF THE DRAWINGS

FIG. 1 shows a cross section of a plate-shaped carrier;

FIG. 2 is a schematic sectional view for illustrating the first step of the method according to the invention;

FIG. 3 is a schematic depiction of a further step of the method according to the invention;

FIG. 4 is a sectional view of a carrier produced by means of the method according to the invention with bristle tufts anchored therein for incorporation into a brush body;

DETAILED DESCRIPTION OF THE PREFERRED EMBODIMENTS

Figure 5:
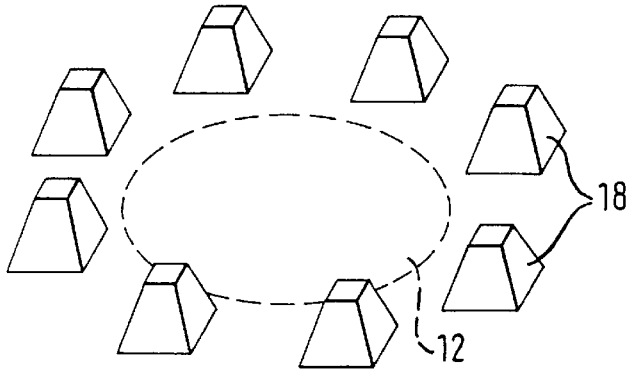
FIG. 5 is a schematic perspective view of a punch used in the method.

The plate-shaped carrier 10 shown in FIG. 1 is made of thermoplastic material and is provided with a multiplicity of holes 12 whose arrangement corresponds to a desired hole pattern or brush field of the brush. As shown in FIG. 2, bristle tufts 14 are inserted into the holes 12 in such a way that their tips 14*a* to be used protrude from one main surface of the carrier 10 while the ends 14*b* to be anchored in the brush protrude slightly from the opposite surface. A heatable punch 16 with a multiplicity of annular projections 18 is positioned vis-ä-vis the ends 14*b* of the bristle tufts 14, as shown in FIG. 2. Then the punch 16, as indicated by an arrow in FIG. 2, is moved against the ends 14*b* of the bristle tufts 14, the projections 18 first penetrating into the material of the carrier 10 between the holes 12 and the bristle tufts 14 inserted in the holes, respectively. In this process, the material of the carrier 10 softens and, at the same time, is displaced against the bristle tufts 14, it also penetrating into the interstices between the bristles, as shown in FIG. 3. The material of the carrier 10 also moves radially and encircles the axial ends 14*b* of the bristle tufts 14. The material of the softened bristles is likewise radially displaced and extends over the raised portions of the carrier that have formed between the penetrated projections 18 of the punch 16, as shown in FIG. 4. This figure clearly shows the tight interlock between the carrier 10 and the deformed ends 14*b* of the bristle tufts 14. As can also be seen in FIG. 4, the ends 14*b* of the bristle tufts, together with the material of the carrier 10 that encircles them and that has penetrated between them, are formed into plateau-like projections. The carrier 10 with the bristle tufts 14 anchored in it can thus be incorporated into a brush body, for example, by being placed into an injection mold and molding with a plastic material. As an alternative, the carriers are attached mechanically to a brush body or they are fused to the brush body, e.g. by means of ultrasonics.

FIG. 5 is a greatly enlarged area of the punch 16 in which the projections 18 are arranged in a pyramid and circular pattern relative to the corresponding holes 12—indicated by a dotted line—of the carrier 10. The ends of the projections are flattened.

Figure 6:
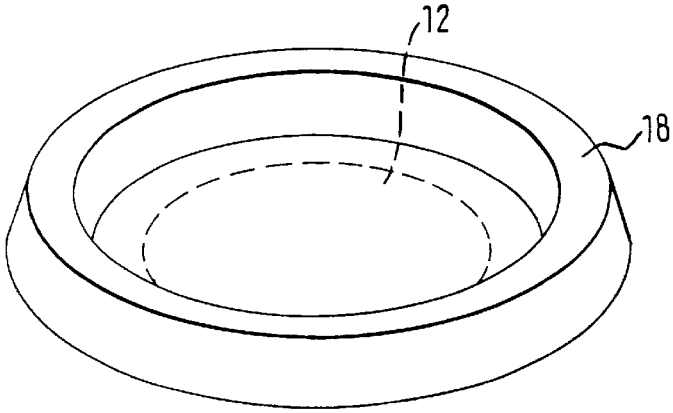
FIG. 6 shows a variant of the punch.

In the embodiment of the punch shown in FIG. 6, the projections are circular and, when engaged with the surface of the carrier 10, each encircle one of it holes 12.

Figure 7:
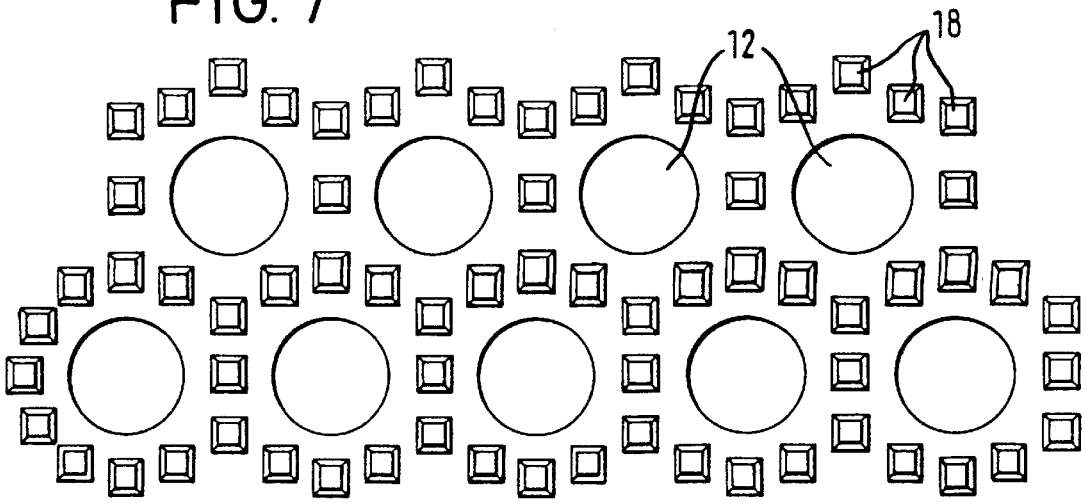
FIGS. 7, 8 and 9 are top views of various embodiments of the punch.

FIG. 7 is a schematic top view of a larger area of the punch 16 in the embodiment according to FIG. 5, that is to say, with pyramidal projections 18 assigned to the holes 12 of the carrier 10.

Figure 8:
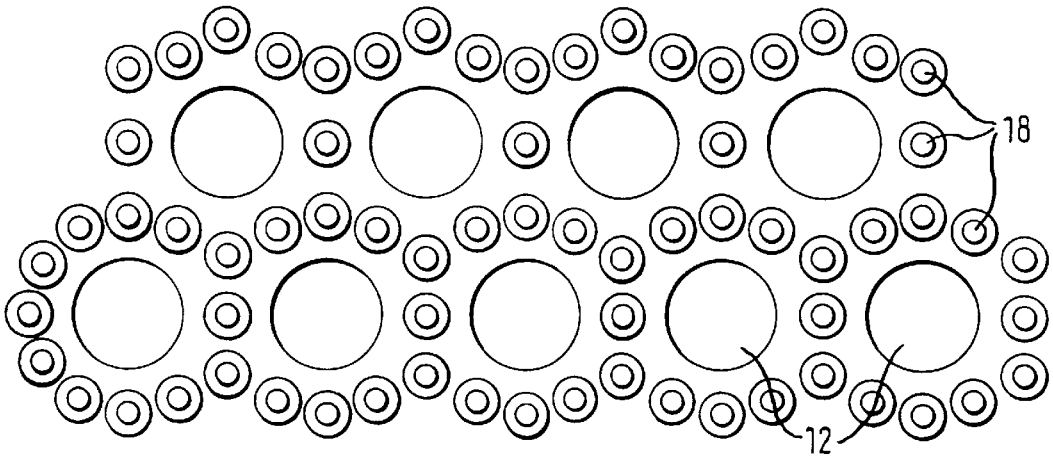

FIG. 8 shows a variant with conical projections 18.

Figure 9:
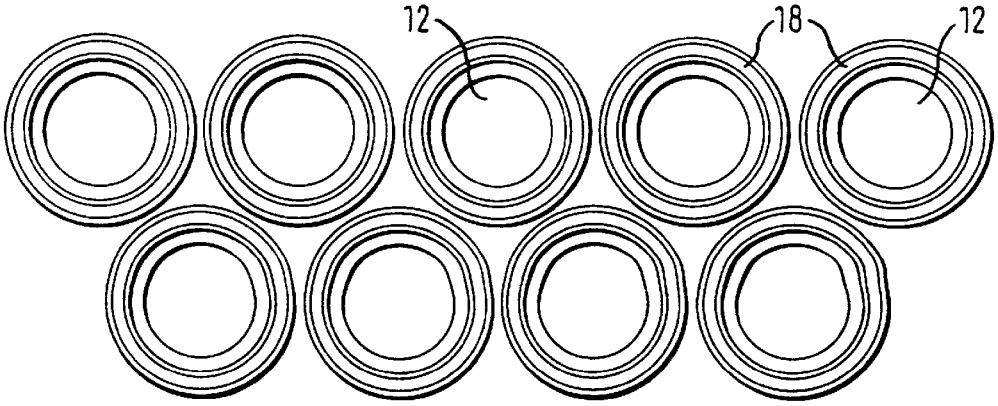

FIG. 9 shows an embodiment of the punch in which the projections 18 have the circular shape shown in FIG. 6.

What is claimed is:

1. A method to attach brush bristle tufts onto carriers made of a thermoplastic material, to be incorporated into brush bodies, wherein:

the carrier is provided with holes corresponding to a desired perforation pattern;

the bristle tufts are inserted into said holes;

a heated punch with projections penetrates between said holes into said material of said carrier, softening it and pushing softened material laterally into interstices between said bristle tufts.

2. The method according to claim 1, wherein surface areas of said punch located between said projections are then pressed against adjacent axial ends of said bristle tufts, softening also said material of said bristles and displacing softened bristle material onto and over deformed material of said carrier in said interstices between said bristle tufts.

3. The method according to claim 1, wherein said projections of said punch have tapered outer ends.

4. The method according to claim 3, wherein said projections are conical.

5. The method according to claim 3, wherein said projections are pyramidal.

6. The method according to claim 1, wherein a plurality of projections distributed over the circumferences of said holes penetrate into said carrier material.

7. The method according to claim 1, wherein each of said projections of said punch encircles a bristle tuft in an annular configuration.

8. The method according to claim 1, wherein said bristle tufts have axial ends protruding from said holes on the surface of said carrier facing said punch and held axially during movement of said punch against said axial ends of said bristle tufts.

9. A device to carry out the method according to claim 1 and comprising a heatable punch with an engagement surface that has a multiplicity of projections arranged relative to tuft insertion holes in a carrier of thermoplastic material to be incorporated in a brush body.

* * * * *